US006894756B2

(12) United States Patent
Moon et al.

(10) Patent No.: US 6,894,756 B2
(45) Date of Patent: May 17, 2005

(54) IN-PLANE SWITCHING MODE LIQUID CRYSTAL DISPLAY DEVICE AND METHOD OF FABRICATING THE SAME

(75) Inventors: Hong-Man Moon, Gyoungsangbuk-Do (KR); Su-Woong Lee, Gyoungsangbuk-Do (KR)

(73) Assignee: LG.Philips LCD Co., Ltd., Seoul (KR)

( * ) Notice: Subject to any disclaimer, the term of this patent is extended or adjusted under 35 U.S.C. 154(b) by 53 days.

(21) Appl. No.: 10/446,662

(22) Filed: May 29, 2003

(65) Prior Publication Data

US 2004/0125057 A1 Jul. 1, 2004

(30) Foreign Application Priority Data

Dec. 31, 2002 (KR) ..... 10-2002-0088436

(51) Int. Cl.[7] ..... G02F 1/13
(52) U.S. Cl. ..... 349/141
(58) Field of Search ..... 349/141, 144, 349/48

(56) References Cited

U.S. PATENT DOCUMENTS

| | | | | |
|---|---|---|---|---|
| 5,598,285 | A | 1/1997 | Kondo et al. | 349/39 |
| 5,745,207 | A | 4/1998 | Asada et al. | 349/141 |
| 5,805,247 | A | 9/1998 | Oh-e et al. | 349/42 |
| 5,831,701 | A | 11/1998 | Matsuyama et al. | 349/110 |
| 5,838,037 | A | 11/1998 | Masutani et al. | 257/296 |
| 5,946,060 | A | 8/1999 | Nishiki et al. | 349/48 |
| 5,990,987 | A | 11/1999 | Tanaka | 349/43 |
| 6,028,653 | A | 2/2000 | Nishida | 349/141 |
| 6,040,887 | A | 3/2000 | Matsuyama et al. | 349/141 |
| 6,097,454 | A | 8/2000 | Zhang et al. | 349/43 |
| 6,266,166 | B1 | 7/2001 | Katsumata et al. | 359/3 |
| 2001/0048500 | A1 * | 12/2001 | Lim et al. | 349/141 |

FOREIGN PATENT DOCUMENTS

| | | |
|---|---|---|
| JP | 9-5764 | 1/1997 |
| JP | 9-73101 | 3/1997 |

OTHER PUBLICATIONS

Lee, S.H., et al., "High–Tranmittance, Wide–Viewing–Angle Nematic Liquid Crystal Display Controlled by Fringe–Field Switching", Asia Display 98, p. 371–374.
Matsumoto, S., et al., "LP–A: Display Characteristics of In–Plane–Switching (IPS) LCDs and a Wide–Viewing–Angle 14.5. IPS TFT–LCD", Euro Display 96, p. 445–448.
Wakemoto, H., et al., "38.1: An Advanced In–Plane–Switching Mode TFT–LCD", SID 97 Digest, p. 929–932.
Kiefer, R. et al., "P2–30 In–Plane Switching of Nematic Liquid Crystals", Japan Display 92, p. 547–550.
Ohta, M. et al., "S30–2 Development of Super–TFT–LCDs with In–Plane Switching Display Mode", Asia Display 95, p. 707–710.
Oh–e, M. et al., "S23–1 Principles and Characteristics of Electro–Optical Behaviour with In–Plane Switching Mode", Asia Display 95, p. 577–560.
Endoh, S., et al., "Advanced 18.1–inch Diagonal Super–TFT–LCDs with Mega Wide Viewing Angle and Fast Response Speed of 20ms" IDW 99, p. 187–190.

* cited by examiner

*Primary Examiner*—James A. Dudek
(74) *Attorney, Agent, or Firm*—Morgan, Lewis & Bockius LLP

(57) ABSTRACT

An in-plane switching mode liquid crystal display device includes a plurality of gate lines and data lines defining a plurality of pixel areas including at least first and second regions, a driving device for supplying a signal to adjacent pixel areas, a plurality of pixel electrodes within the first and second regions within the pixel area, the pixel electrodes being supplied a first data voltage from the driving device of the corresponding pixel to the first region and being supplied a second voltage from the driving device of an adjacent pixel within the second region, and a plurality of common electrodes within the first and second regions of the pixel areas for forming a horizontal electric field together with the pixel electrodes.

30 Claims, 4 Drawing Sheets

IN-PLANE SWITCHING MODE LIQUID CRYSTAL DISPLAY DEVICE AND METHOD OF FABRICATING THE SAME

The present invention claims the benefit of Korean Patent Application No. 88436/2002 filed in Korea on Dec. 31, 2002, which is hereby incorporated by reference.

BACKGROUND OF THE INVENTION

1. Field of the Invention

The present invention relates to a liquid crystal display device and a method of fabricating a liquid crystal display device, and more particularly, to an in-plane switching mode liquid crystal display device and method of fabricating an in-plane switching liquid crystal display device.

2. Description of the Related Art

Presently, various portable electronic devices, such as mobile phones, PDAs, and notebook computers are being developed that require flat panel display devices. Liquid crystal display (LCD) devices, plasma display panel (PDP) devices, field emission display (FED) devices, and vacuum fluorescent display (VFD) devices are actively being developed as flat panel display devices. Among these various devices, the LCD devices are appealing because of their mass production techniques, ease of driving, and implementation of high picture quality.

In the liquid crystal display device, there are various display modes according to arrangement of liquid crystal molecules of a liquid crystal layer. A Twisted Nematic (TN) mode is commonly used because of its simple display of black and white images, fast response time, and low driving voltage. In the TN-mode liquid crystal display device, liquid crystal molecules that are initially aligned along a horizontal direction to the substrate are subsequently aligned almost vertically to the substrate when a voltage is applied to the liquid crystal layer. Accordingly, viewing angle becomes narrow due to a refractive anisotropy of the liquid crystal molecules when the voltage is applied.

To solve the viewing angle problem, there have been proposed LCD devices with various display modes having wide viewing angle characteristics. Of the LCD devices, an in-plane switching (IPS) mode liquid crystal display device has been adopted in which at least a pair of electrodes are arranged in parallel within a pixel region to form a horizontal electric field substantially parallel to the surface of a substrate, thereby aligning liquid crystal molecules within a single plane.

FIG. 1A is a plan view of an in-plane switching mode LCD device according to the related art, and FIG. 1B is a cross sectional view along I–I' of FIG. 1A according to the related art. In FIG. 1A, a pixel of a liquid crystal display panel 1 is defined by a gate line 3 and a data line 4 arranged along longitudinal and transverse directions. Although FIG. 1A only shows an (n, m)th pixel, an N (>n) number of gate lines 3 and an M (>m) number of data lines 4 are arranged on the liquid crystal display panel 1 to form an N×M matrix of pixels. A thin film transistor 10 is formed at a crossing region of the gate line 3 and the data line 4 within the pixel region. The thin film transistor 10 includes a gate electrode 11 to which a scan signal is supplied from the gate line 3, a semiconductor layer 12 formed on the gate electrode 11 and activated as the scan signal is supplied to form a channel layer, and a source electrode 13 and a drain electrode 14 to which an image signal is supplied through the data line 4 and formed on the semiconductor layer 13 in order to supply an image signal input from an outer side to a liquid crystal layer.

A plurality of common electrodes 5 and pixel electrodes 7 are arranged to be parallel with the data line 4 within the pixel region. In addition, a common line 16 connected to the common electrode 5 is disposed on a center portion of the pixel region, and a pixel electrode line 18 connected to the pixel electrode 7 is disposed on the common line 16 to overlap with each other. A storage capacitance is formed by the overlap of the common line 16 and the pixel electrode line 18 in the IPS-mode LCD device.

Accordingly, in the IPS-mode LCD device, the liquid crystal molecules are oriented to be parallel with the common electrode 5 and the pixel electrode 7. When a signal is supplied to the pixel electrode 7 by operation of the thin film transistor 10, a horizontal electric field parallel with a surface of the liquid crystal display panel 1 is generated between the common electrode 5 and the pixel electrode 7. Accordingly, the liquid crystal molecules are rotated along a same plane with the horizontal electric field. Thus, grey inversion due to the refractive anisotropy of the liquid crystal molecules can be prevented.

In FIG. 1B, the gate electrode 11 is formed on the first substrate 20, and a gate insulating layer 22 is deposited on an entire surface of the first substrate 20. A semiconductor layer 12 is formed on the gate insulating layer 22, and the source electrode 13 and the drain electrode 14 are formed thereon. In addition, a passivation layer 24 is formed on an entire surface of the first substrate 20. A plurality of common electrodes 5 are formed on the first substrate 20, and the pixel electrode 7 and the data line 4 are formed on the gate insulating layer 22. Accordingly, the horizontal electric field is generated between the common electrode 5 and the pixel electrode 7.

A black matrix 32 and a color filter layer 34 are formed on a second substrate 30. The black matrix 32 prevents light from leaking toward an area where alignment of the liquid crystal molecules are not controlled by the electric field, and is formed mainly on an area of the thin film transistor 10 between adjacent pixels (i.e., the gate line and the data line areas). The color filter layer 34 includes red (R), green (G), and blue (B) sub-color filters for generating colored images, and a liquid crystal layer 40 is formed between the first substrate 20 and the second substrate 30.

Operating methods of the IPS-mode LCD device can be classified into one of three different inversion methods in accordance with a phase of the data voltage that is supplied to the data line. These methods include a line inversion method, a column inversion method, and a dot inversion method. The line inversion method inverts the phase of the data voltage supplied to the data line 4 according to the gate signal supplied to the gate line 3. The column inversion method inverts the phase of the data voltage supplied to the data line 4 at every column. The dot inversion method inverts the phase of polarity of the voltage supplied to the data line 4 at every column and line simultaneously. The phase of the data voltage is inverted and supplied to the data line in order to prevent generation of cross-talk on a display screen due to degradation of the liquid crystal material when the same voltage is continuously supplied between adjacent pixel and common electrodes.

However, using the dot inversion method in the IPS-mode LCD device is problematic. For example, as shown in FIG. 1A, one common voltage is supplied to one pixel such that a positive voltage and a negative voltage of the data voltage should be repeated at every frame for the dot inversion operation. Accordingly, when the data voltage is changed from the positive to the negative, a variation is generated on the common electrode by the voltage difference of the data voltage, and the variation causes generating flicker of the displayed image, residual image, or a horizontal dim.

SUMMARY OF THE INVENTION

Accordingly, the present invention is directed to an in-plane switching mode liquid crystal display device and a method of fabricating an in-plane switching mode liquid crystal display device that substantially obviates one or more of the problems due to limitations and disadvantages of the related art.

An object of the present invention is to provide an in-plane switching (IPS) mode liquid crystal display (LCD) device having a data voltage applied to a pixel as different voltages.

Another object of the present invention is to provide a method of fabricating an in-plane switching (IPS) mode liquid crystal display (LCD) device having a data voltage applied to a pixel as different voltages.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, an in-plane switching mode liquid crystal display device includes a plurality of gate lines and data lines defining a plurality of pixel areas including at least first and second regions, a driving device for supplying a signal to adjacent pixel areas, a plurality of pixel electrodes within the first and second regions within the pixel area, the pixel electrodes being supplied a first data voltage from the driving device of the corresponding pixel to the first region and being supplied a second voltage from the driving device of an adjacent pixel within the second region, and a plurality of common electrodes within the first and second regions of the pixel areas for forming a horizontal electric field together with the pixel electrodes.

In another aspect, an in-plane switching mode liquid crystal display device includes a plurality of gate lines and data lines, and a plurality of pixels including a thin film transistor, each pixel having first and second regions, the first region including a first pixel electrode and a first common electrode arranged in parallel for generating a horizontal electric field as a first data voltage and a common voltage are applied thereto, the second region including a second pixel electrode and a second common electrode for forming the horizontal electric field as a second data voltage and a common voltage are applied thereto.

In another aspect, a method of fabricating an in-plane switching mode liquid crystal display device includes forming a plurality of gate lines and data lines defining a plurality of pixel areas including at least first and second regions on a substrate, forming a driving device for supplying a signal to adjacent pixel areas, forming a plurality of pixel electrodes within the first and second regions within the pixel area, the pixel electrode being supplied a first data voltage from the driving device of the corresponding pixel to the first region and being supplied a second voltage from the driving device of an adjacent pixel within the second region, and forming a plurality of common electrodes within the first and second regions of the pixel areas for forming a horizontal electric field together with the pixel electrode.

In another aspect, a method of fabricating an in-plane switching mode liquid crystal display device includes forming a plurality of gate lines and data lines on a substrate, and forming a plurality of pixels including a thin film transistor, each pixel having first and second regions, the first region including a first pixel electrode and a first common electrode arranged in parallel for generating a horizontal electric field as a first data voltage and a common voltage are applied thereto, the second region including a second pixel electrode and a second common electrode for forming the horizontal electric field as a second data voltage and a common voltage are applied thereto.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EXEMPLARY EMBODIMENTS

Reference will now be made in detail to the exemplary embodiments of the present invention, examples of which are illustrated in the accompanying drawings.

Figure 1A:
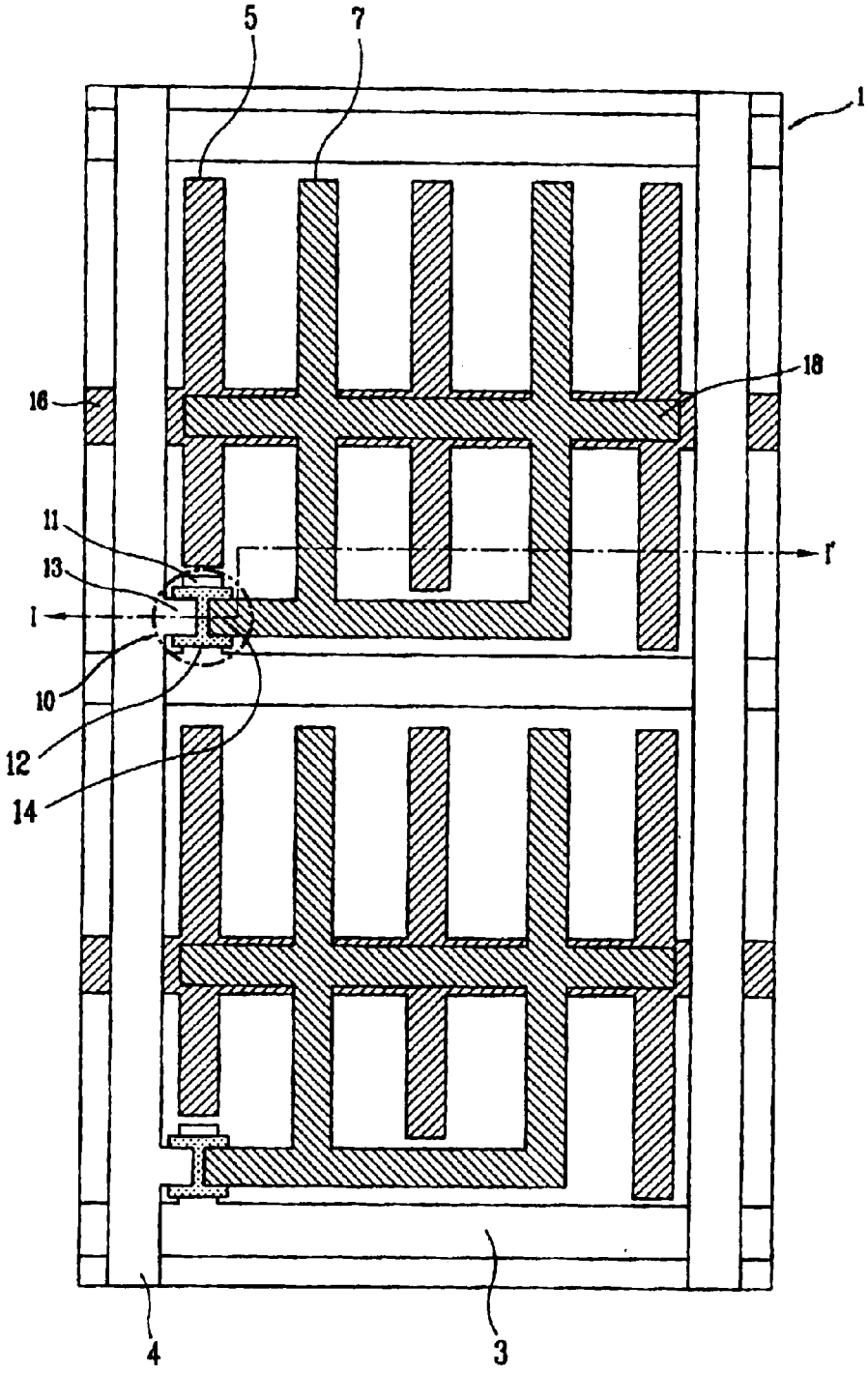
FIG. 1A RELATED ART
FIG. 1A is a plan view of an in-plane switching mode LCD device according to the related art.
Figure 1B:
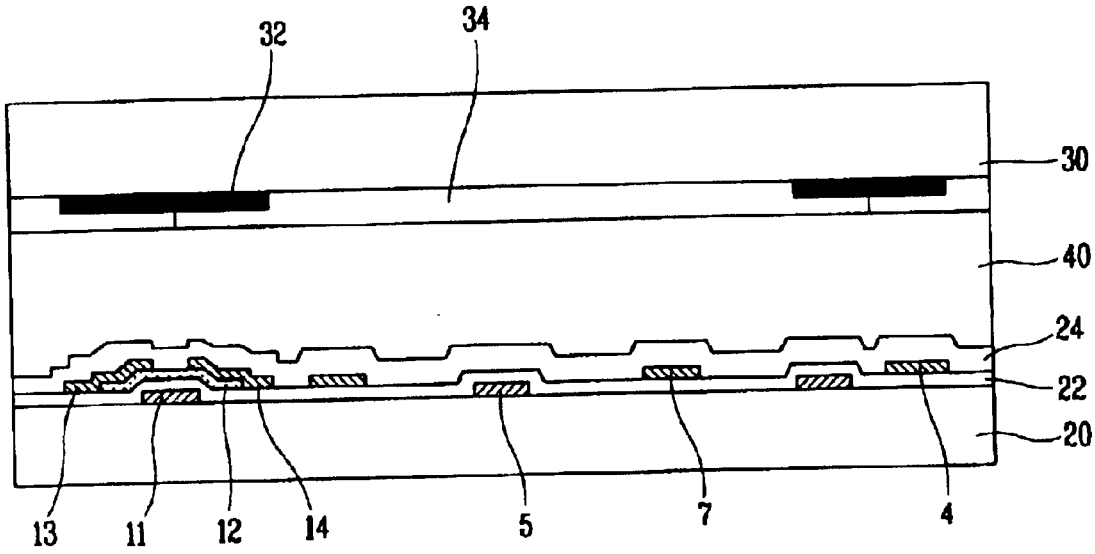
FIG. 1B RELATED ART
FIG. 1B is a cross sectional view along I–I' of FIG. 1A according to the related art.
Figure 2:
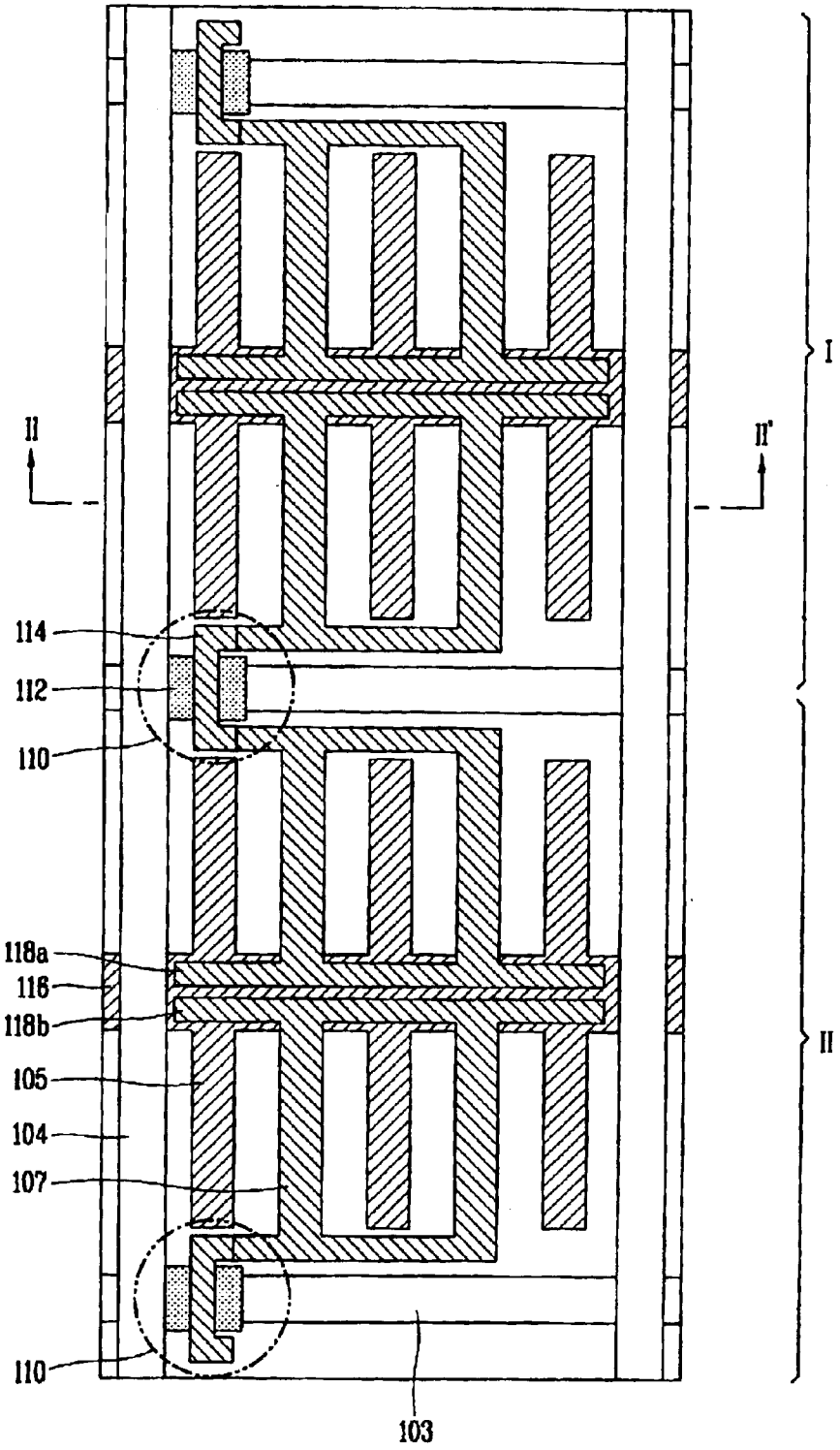
FIG. 2 is a plan view of an exemplary IPS-mode LCD device according to the present invention.
Figure 3:
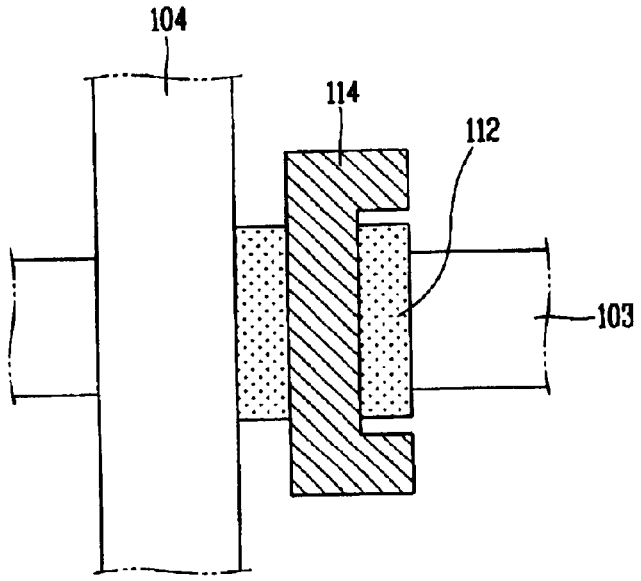
FIG. 3 is an expanded view of an exemplary thin film transistor in the IPS mode LCD device of FIG. 2 according to the present invention.

FIG. 2 is a plan view of an exemplary IPS-mode LCD device according to the present invention. In FIG. 2, an IPS-mode LCD device may include a plurality of pixels defined by a plurality of gate lines 103 and data lines 104 arranged along longitudinal and transverse directions. In addition, a thin film transistor 110 may be formed above and on the gate line 103, and may be disposed on both adjacent first and second pixels I and II. Specifically, the gate electrode of the thin film transistor 110 may be formed of the gate line 103, and a source electrode may be formed on the data line 104.

Although it is not shown, a gate insulating layer may be formed on the gate line 103, and a semiconductor layer 112 may be formed on the gate insulating layer with a drain electrode 114 formed on a portion of the semiconductor layer 112. The semiconductor layer 112 may be disposed under both the drain electrode 114 and the data line 104 to form a channel layer between the drain electrode 114 and the data line 104 when a signal is input through a gate electrode.

In FIG. 2, the drain electrode 114 of the thin film transistor 110 may be formed on the adjacent first and second pixels I and II. Accordingly, when the signal is supplied to the gate line 103 and the channel layer is formed in the semiconductor layer 112, the data voltage input through the data line 104 may be simultaneously applied to the adjacent first and second pixels I and II.

A plurality of common electrodes 105 and a plurality of pixel electrodes 107 may be formed within a single pixel region. In addition, a common line 116 connected to the common electrodes 105 may be disposed within a center portion of the pixel region, and pixel electrode lines 118*a* and 118*b* connected to the pixel electrode 107 may be overlapped with the pixel electrode 107.

The pixel region may be divided into two adjacent pixel region that may be center around and formed on opposite sides of the common line 116. The two adjacent pixel regions may include a first region that includes the pixel electrode line 118*a* and a corresponding first portion of the pixel electrode 107 and a second region that includes the pixel electrode line 118*b* and a corresponding second portion of the pixel electrode 107. For example, the first portion of pixel electrode 107 formed within the first region and the second portion of the pixel electrode 107 formed within the second region may be electrically short-circuited. Accordingly, the data voltage may be supplied from the data line 104 to the first portion of the pixel electrode 107 of the first area and the second portion of the pixel electrode 107 of the second are via the thin film transistor 110. In addition, the data voltage may be supplied from the data line 104 to another first portion of the pixel electrode 107 on the second area from the thin film transistor of a neighboring pixel region. Thus, the first and second regions of a single pixel may be operated by different signals as centering around the common line 116, and the first region and the second region of two neighboring pixels centering around the gate line 103 may be operated by a same data voltage. Moreover, the first region and the second region in the pixel may have opposite polarities during the dot inversion operation. For example, when the positive data voltage is supplied to the first region of the pixel, the negative data voltage may be supplied to the second region of the pixel. Likewise, when the negative data voltage may be supplied to the first region of the pixel, then the positive data voltage may be supplied to the second region of the pixel.

The common electrodes 105 formed on the first and second regions of the pixel may be connected to the common line 116. For example, the common voltages supplied through the common line 116 may be the same on the first and second regions of the pixel.

According to the IPS-mode LCD device of the present invention, one pixel may be divided into two areas, and the data voltage may be supplied to adjacent areas centering around the gate line. In addition, different data voltages may be applied to respective areas within one pixel area. Moreover, the two areas within the pixel are may share the common line 116 disposed in the pixel, and therefore, the same common voltage may be supplied thereto.

When the data voltage is changed from positive to negative during an image frame change, the variation of the common voltage by the difference of the data voltage is generated on the first and second regions of the pixel as opposite polarities. For example, the variations of the common electrode on the first and second regions of the pixel may be generated as different polarities from each other, and then, the variation of the common electrode within the pixel may be compensated by each other, and consequently, the variation of the common electrode may be removed. Accordingly, the variation of the common voltage may be prevented, and therefore, generation of flicker, residual images or horizontal dim may be prevented.

Figure 4:
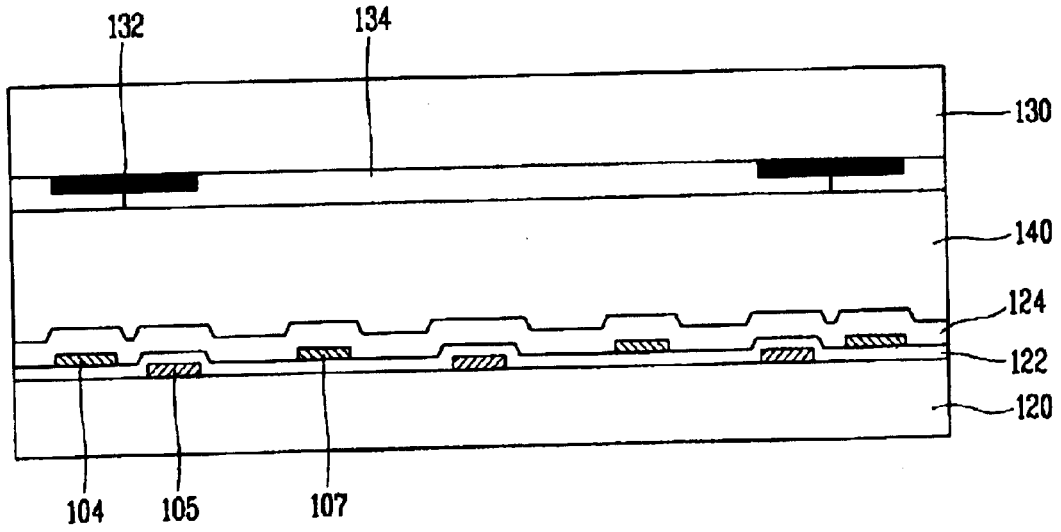
FIG. 4 is a cross sectional view along II–II' of FIG. 2 according to the present invention.

FIG. 4 is a cross sectional view along II–II' of FIG. 2 according to the present invention. In FIG. 4, the common electrode 105 may be formed on the first substrate 120, and the gate insulating layer 122 may be deposited thereon. In addition, the pixel electrode 107 may be formed on the gate insulating layer 122, wherein a horizontal electric field may be generated between the common electrode 105 and the pixel electrode 107.

The common electrode 105 may include a single material layer or a plurality of multiple layers that include Cu, Mo, Ta, Ti, Al, or an Al alloy using evaporation or sputtering methods. Then, the material(s) may be etched. Similarly, the pixel electrode 107 may include a single material layer or a plurality of material layers that include Mo, Cu, Ta, Ti, Al, or an Al alloy using evaporation or sputtering methods, and etching the material(s) using an etchant. In addition, the common electrode 105 and the pixel electrode 107 may be formed using transparent materials, such as indium tin oxide (ITO) or indium zinc oxide (IZO), for improving an aperture ratio.

The common electrode 105 and the pixel electrode 107 may not always be formed on the first substrate 120 and the gate insulating layer 122. The common electrode 105 and the pixel electrode 107 may be formed on the first substrate 120 and on the gate insulating layer 122, and may be formed on the passivation layer 124. In addition, the common electrode 105 may be formed on the gate insulating layer 122 or on the passivation layer 124, and the pixel electrode 107 may be formed on the first substrate 120.

A black matrix 132 and a color filter layer 134 may be formed on the second substrate 130, and a liquid crystal layer 140 may be disposed between the first and second substrates 120 and 130. Although not shown, an overcoat layer may be formed on the color filter layer 134 to improve flatness of the second substrate 130 and for protecting the color filter layer 134.

The liquid crystal layer 140 may be formed using a liquid crystal vacuum injection method that injects the liquid crystal material between the attached first and second substrates 120 and 130. Alternatively, the liquid crystal layer may be formed using a liquid crystal dispensing method, wherein the liquid crystal material is directly dropped onto the first or second substrate. Then, the liquid crystal material may be evenly dispersed between the attached first and second substrates 120 and 130.

The present invention is not limited to the IPS-mode LCD device. Moreover, although the IPS-mode LCD device of a four-block configuration in which four light transmittance areas are formed by forming two pixel electrodes and three common electrodes within the pixel, the present invention may be applied to any IPS-mode LCD device, such as two-block or six-block configurations.

In the IPS-mode LCD device according to the present invention, different data voltages may be supplied to the pixel electrodes of the first and second region within the pixel by the different thin film transistors disposed along with the gate line, and the same common voltage may be applied to the common electrodes of the first and second regions through the common line disposed on the center portion of the pixel. Thus, the variations of the common voltages on the first and second regions may be compensated by each other during the dot inversion operation.

It will be apparent to those skilled in the art that various modifications and variations can be made in the in-plane switching mode liquid crystal display device of the present invention without departing from the spirit or scope of the invention. Thus, it is intended that the present invention cover the modifications and variations of this invention provided they come within the scope of the appended claims and their equivalents.

What is claimed is:

1. An in-plane switching mode liquid crystal display device, comprising:

a plurality of gate lines and data lines defining a plurality of pixel areas including at least first and second regions;

a driving device for supplying a signal to adjacent pixel areas;

a plurality of pixel electrodes within the first and second regions within the pixel area, the pixel electrodes being supplied a first data voltage from the driving device of the corresponding pixel to the first region and being supplied a second voltage from the driving device of an adjacent pixel within the second region; and a plurality of common electrodes within the first and second regions of the pixel areas for forming a horizontal electric field together with the pixel electrodes.

2. The device according to claim 1, wherein the driving device includes a thin film transistor.

3. The device according to claim 2, wherein the thin film transistor comprises:

a gate line;

a gate insulating layer on the gate line;

a semiconductor layer on the gate insulating layer; and a data line and a drain electrode on the semiconductor layer.

4. The device according to claim 3, wherein the drain electrode is connected to the pixel electrode of an adjacent pixel.

5. The device according to claim 3, wherein the common electrode and the pixel electrode are disposed on a same layer.

6. The device according to claim 5, wherein the common electrode and the pixel electrode are disposed on one of the substrate, the gate insulating layer, and a passivation layer.

7. The device according to claim 3, wherein the common electrode is formed on the substrate and the pixel electrode is disposed on the gate insulating layer.

8. The device according to claim 3, wherein the common electrode is disposed on the gate insulating layer and the pixel electrode is disposed on the substrate.

9. The device according to claim 1, further comprising:

a common line disposed within the pixel and connected to the common electrode; and a first pixel electrode line overlapping the common line and connected to the pixel electrode within the first region and a second pixel electrode line connected to the pixel electrode within the second region.

10. The device according to claim 9, wherein the first pixel electrode line and the second pixel electrode line are short-circuited with each other.

11. The device according to claim 1, wherein the common voltages are varied as different polarities from each other within the first and second regions and compensated during a dot inversion operation.

12. An in-plane switching mode liquid crystal display device, comprising:

a plurality of gate lines and data lines; and a plurality of pixels including a thin film transistor, each pixel having first and second regions, the first region including a first pixel electrode and a first common electrode arranged in parallel for generating a horizontal electric field as a first data voltage and a common voltage are applied thereto, the second region including a second pixel electrode and a second common electrode for forming the horizontal electric field as a second data voltage and a common voltage are applied thereto.

13. The device according to claim 12, wherein the first data voltage and the second data voltage are supplied through the thin film transistors of the corresponding pixel and of an adjacent pixel.

14. The device according to claim 13, wherein the first data voltage and the second data voltage have opposite polarities from each other during a dot inversion driving method.

15. The device according to claim 14, wherein variations of the common voltages are generated as different polarities from each other within the first and second regions.

16. A method of fabricating an in-plane switching mode liquid crystal display device, comprising:

forming a plurality of gate lines and data lines defining a plurality of pixel areas including at least first and second regions on a substrate;

forming a driving device for supplying a signal to adjacent pixel areas;

forming a plurality of pixel electrodes within the first and second regions within the pixel area, the pixel electrode being supplied a first data voltage from the driving device of the corresponding pixel to the first region and being supplied a second voltage from the driving device of an adjacent pixel within the second region; and forming a plurality of common electrodes within the first and second regions of the pixel areas for forming a horizontal electric field together with the pixel electrode.

17. The method according to claim 16, wherein forming the driving device includes forming a thin film transistor.

18. The method according to claim 17, wherein forming the thin film transistor comprises:

forming a gate line;

forming a gate insulating layer on the gate line;

forming a semiconductor layer on the gate insulating layer; and forming a data line and a drain electrode on the semiconductor layer.

19. The method according to claim 18, wherein the drain electrode is connected to the pixel electrode of an adjacent pixel.

20. The method according to claim 19, wherein the common electrode and the pixel electrode are formed on a same layer.

21. The method according to claim 20, wherein the common electrode and the pixel electrode are formed on one of the substrate, the gate insulating layer, and a passivation layer.

22. The method according to claim 20, wherein the common electrode is formed on the substrate and the pixel electrode is disposed on the gate insulating layer.

23. The method according to claim 20, wherein the common electrode is formed on the gate insulating layer and the pixel electrode is formed on the substrate.

24. The method according to claim 16, further comprising:

forming a common line within the pixel and connected to the common electrode;

forming a first pixel electrode line overlapping the common line and connected to the pixel electrode within the first region; and forming a second pixel electrode line connected to the pixel electrode within the second region.

25. The method according to claim 24, wherein the first pixel electrode line and the second pixel electrode line are formed to be short-circuited with each other.

26. The method according to claim 16, wherein the common voltages are varied as different polarities from each other within the first and second regions and compensated during a dot inversion operation.

27. A method of fabricating an in-plane switching mode liquid crystal display device, comprising:

forming a plurality of gate lines and data lines on a substrate; and forming a plurality of pixels including a thin film transistor, each pixel having first and second regions, the first region including a first pixel electrode and a first common electrode arranged in parallel for generating a horizontal electric field as a first data voltage and a common voltage are applied thereto, the second region including a second pixel electrode and a second common electrode for forming the horizontal electric field as a second data voltage and a common voltage are applied thereto.

28. The method according to claim 27, wherein the first data voltage and the second data voltage are supplied through the thin film transistors of the corresponding pixel and of an adjacent pixel.

29. The method according to claim 27, wherein the first data voltage and the second data voltage have opposite polarities from each other during a dot inversion driving method.

30. The device according to claim 27, wherein variations of the common voltages are generated as different polarities from each other within the first and second regions.

* * * * *